US005665946A

United States Patent [19]

Nishijima et al.

[11] Patent Number: 5,665,946

[45] Date of Patent: Sep. 9, 1997

[54] COMBINED-OPERATION TYPE SWITCHING APPARATUS INCLUDING ROTATIONAL AND PUSH OPERATORS

[75] Inventors: Akio Nishijima; Takashi Asakawa, both of Iwaki; Shuichi Matsumoto, Kanagawa, all of Japan

[73] Assignees: Alps Electric Co., Ltd.; Sony Corporation, both of Tokyo, Japan

[21] Appl. No.: 539,644

[22] Filed: Oct. 5, 1995

[30] Foreign Application Priority Data

Oct. 7, 1994 [JP] Japan ..... 6-244228

[51] Int. Cl.[6] ..... H01H 9/00

[52] U.S. Cl. ..... 200/4; 200/5 R; 200/18

[58] Field of Search ..... 200/4, 5 R, 17 R, 200/18, 302.1, 302.3, 61.27–61.38, 61.54–61.57, 52 R

[56] References Cited

U.S. PATENT DOCUMENTS

| | | | |
|---|---|---|---|
| 3,499,125 | 3/1970 | Stoi | 200/4 |
| 3,511,943 | 5/1970 | Kibler | 200/4 |
| 4,180,713 | 12/1979 | Gonzales | 200/52 R |
| 4,225,758 | 9/1980 | Kondo et al. | 200/4 |
| 4,273,971 | 6/1981 | Tregurtha | 200/4 |
| 4,394,546 | 7/1983 | Harumatsu | 200/5 R |
| 5,003,132 | 3/1991 | Lagier | 200/4 |
| 5,107,243 | 4/1992 | Maeda | 200/61.27 X |
| 5,510,810 | 4/1996 | Nishijima et al. | 345/156 |

*Primary Examiner*—J. R. Scott

*Attorney, Agent, or Firm*—Guy W. Shoup; Patrick T. Bever

[57] ABSTRACT

A combined-operation type switching apparatus which is downsized and exhibits excellent operability. An operation unit is rotatably and slidably held by a housing. An operation ring is also rotatably held by the housing. The operation ring is rotated together with the operation unit only when the operation unit is pressed. A drive unit is movably supported by a shaft of the operation unit via a spring. A push switch (swell) actuated by pressing the drive unit and rotation detecting switches (projections) actuated by rotating a drive rod of the operation ring are placed inside the housing. A first pair of rotation detecting switches is actuated by rotation of the operation unit when the operation unit is not pressed. The push switch and a second pair of rotation detection switches are actuated by pressing the operation unit such that the operation unit slides along its axis toward the push switch, and then rotating the operation unit. The second pair of rotation detecting switches is actuated (without actuating the push switch) by rotation of the operation ring without pressing the operation unit. In this manner, a plurality of switch operations are performed with a minimal number of members.

7 Claims, 8 Drawing Sheets

COMBINED-OPERATION TYPE SWITCHING APPARATUS INCLUDING ROTATIONAL AND PUSH OPERATORS

BACKGROUND OF THE INVENTION

1. Field of the Invention

The present invention relates to a combined-operation type switching apparatus which is capable of switching a plurality of contacts by rotating or sliding (pressing) an operation unit.

2. Description of the Related Art

A conventional multi-switching apparatus installed in a vehicle has been disclosed in, for example, Japanese Patent Laid-Open No. 1-269106. In this switching apparatus, a switching device having a plurality of sets of contacts is disposed inside a housing, and a plurality of keys for actuating the respective contacts are arranged on the top surface of the housing. The switching device is formed of an insulating base provided with a plurality of fixed contacts and a rubber sheet provided with respective movable contacts on the inner bottom surfaces of a plurality of dome-like swells. This rubber sheet is placed on the insulating base in such a manner that the respective movable contacts are spaced from the associated fixed contacts by a predetermined spacing provided by the dome-like swells. The switching apparatus constructed as described above is operated as follows. When the operator presses a certain key, the corresponding swell formed on the rubber sheet is selectively buckled and deformed due to the pressed key. Accordingly, the movable contact provided on the inner bottom surface of the deformed swell comes into contact with the associated fixed contact provided for the insulating base, thereby changing the switch to the on state.

However, the conventional switching apparatus of this type encounters the following problems. Since a plurality of keys are arranged in the same plane of the housing, the overall switching apparatus inevitably becomes large horizontally. It is thus difficult to mount the switching apparatus in a narrow space, such as somewhere around the steering wheel of a vehicle. In addition, to actuate a particular switch, it is required that the operator visually select one of the plurality of keys. Hence, the switching apparatus of this type is not adaptable for the type in which the driver feels for a desired key to actuate it by touch while driving.

SUMMARY OF THE INVENTION

Accordingly, in view of the above-described background of the related art, an object of the present invention is to provide a combined-operation type switching apparatus which is small in size and exhibits excellent operability.

In order to achieve the above object, the present invention provides a combined-operation type switching apparatus comprising: a housing having a guide tube; an operation unit having a shaft rotatably and slidably inserted into the guide tube; a rotation detecting switch operable by a rotating operation of the operation unit; a push switch operable by a sliding operation of the operation unit; and a drive unit movably held by the shaft via a spring so as to drive the push switch, a sliding amount of the operation unit being set greater than a stroke amount of a movable contact provided for the push switch.

An operation ring for actuating the rotation detecting switch may be coaxially disposed in the vicinity of the operation unit. Engaging means may also be respectively provided for the operation unit and the operation ring so that the operation ring and the operation unit are movable in the rotating direction when a sliding operation is performed on the operation unit. In such a case, the rotation area of the operation ring may differ from the operation area of the operation unit.

Further, the movable contact of the push switch may be disposed on the inner bottom surface of a swell formed in a rubber sheet, and a lubricating sheet may intervene between the drive unit and the top surface of the swell.

When the operation unit is singly rotated either in the normal or reverse direction, the rotation detecting switch is actuated, and a specific switching signal is output. On the other hand, when the operation unit is singly pressed, the push switch is actuated by the drive unit, which is held by the shaft of the operation unit via a spring, and another type of switching signal is thus output. When the operation unit is rotated and pressed in a combined manner, both the rotation detecting switch and the push switch are actuated. Accordingly, still another type of switching signal is output. For these operations, a sliding amount of the operation unit is set greater than a stroke of the movable contact provided for the push switch. Accordingly, the movable contact of the push switch comes into contact with the fixed contact due to the elasticity of a spring. The contact state between the fixed and moveable contacts can be reliably maintained even when the operation unit is rotated.

DESCRIPTION OF THE PREFERRED EMBODIMENTS

An embodiment of the present invention will now be described with reference to the drawings.

Figure 1:
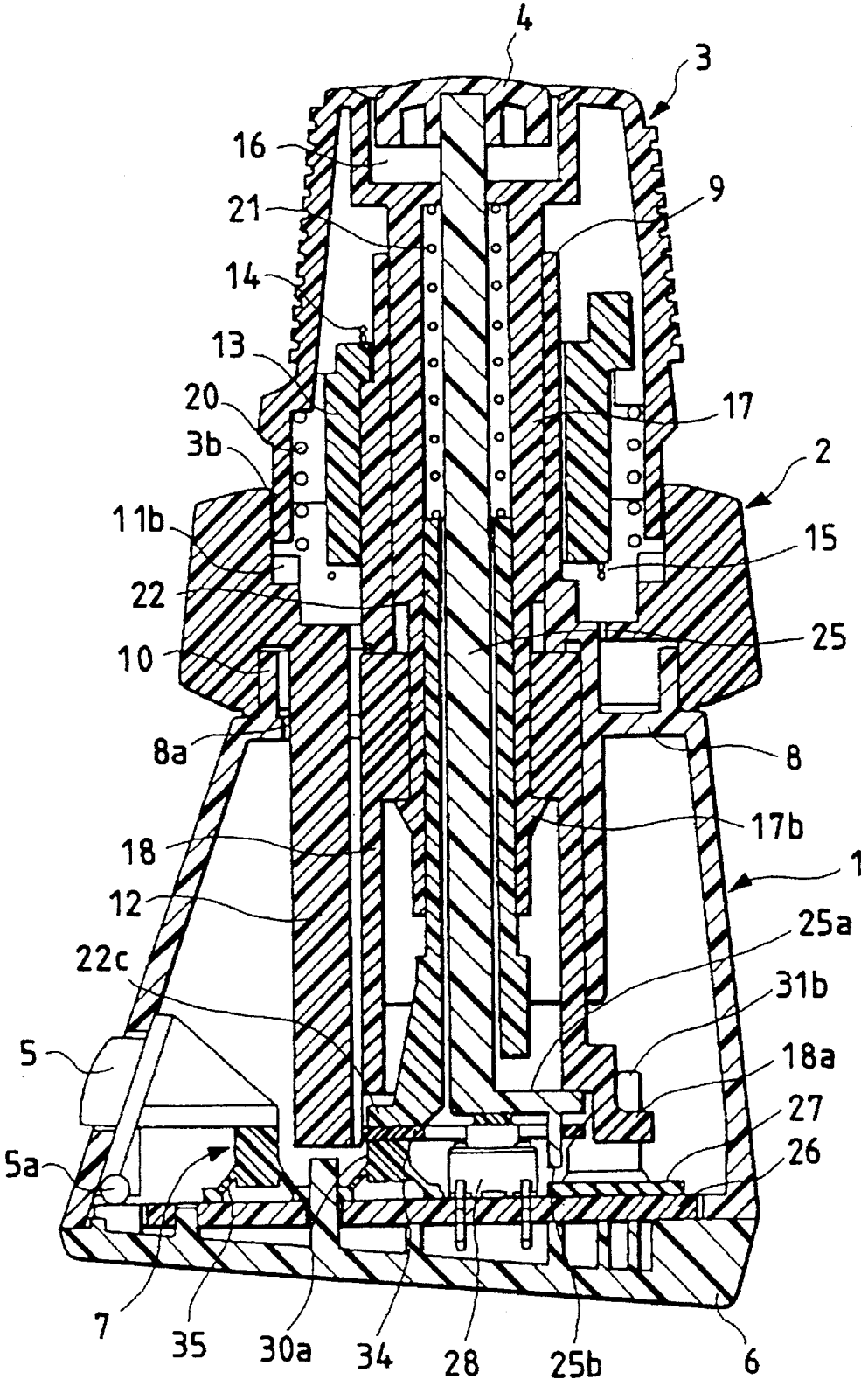
FIG. 1 is a front longitudinal sectional view of a combined-operation type switching apparatus according to an embodiment of the present invention.
Figure 2:
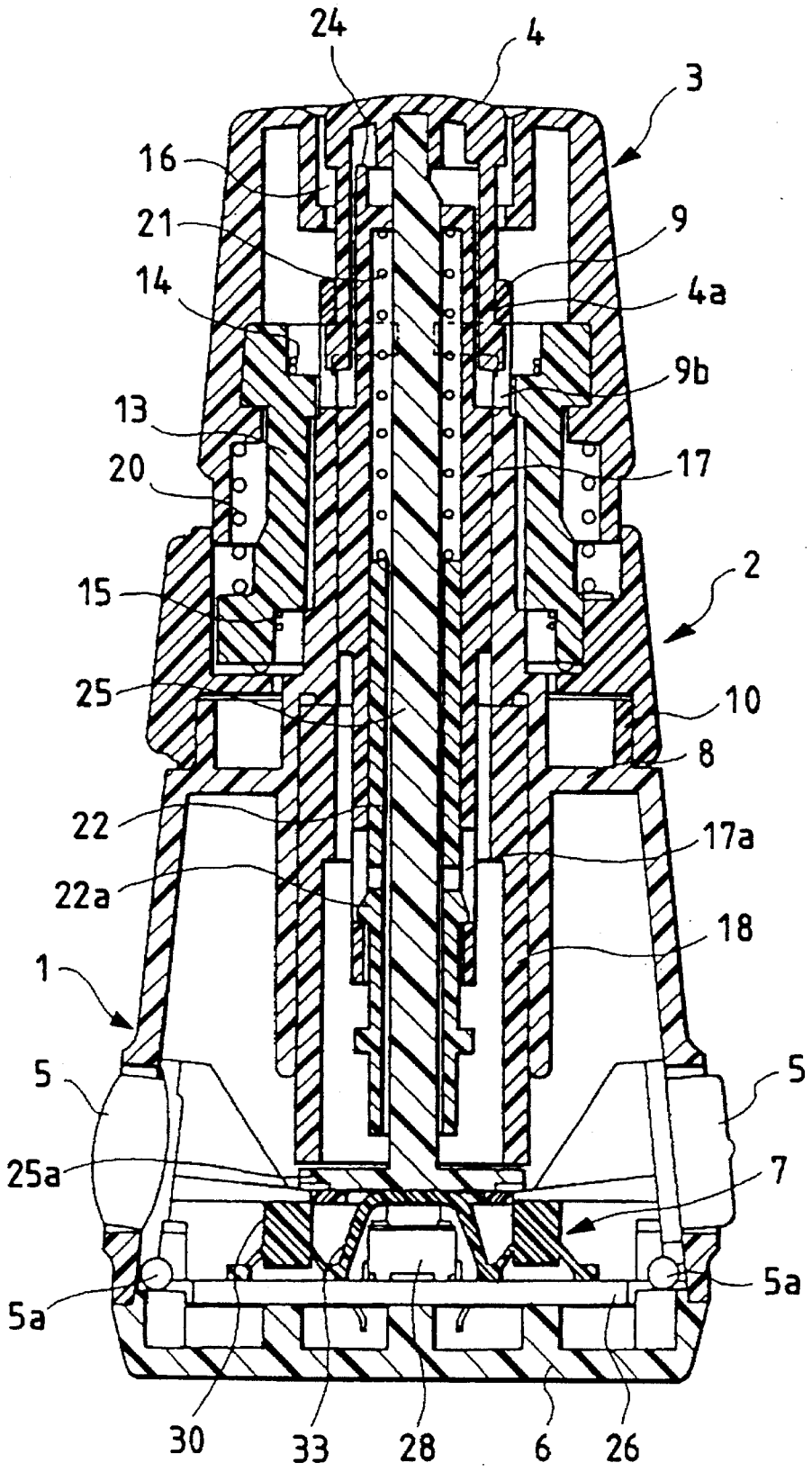
FIG. 2 is a side longitudinal sectional view of the switching apparatus.
Figure 3:
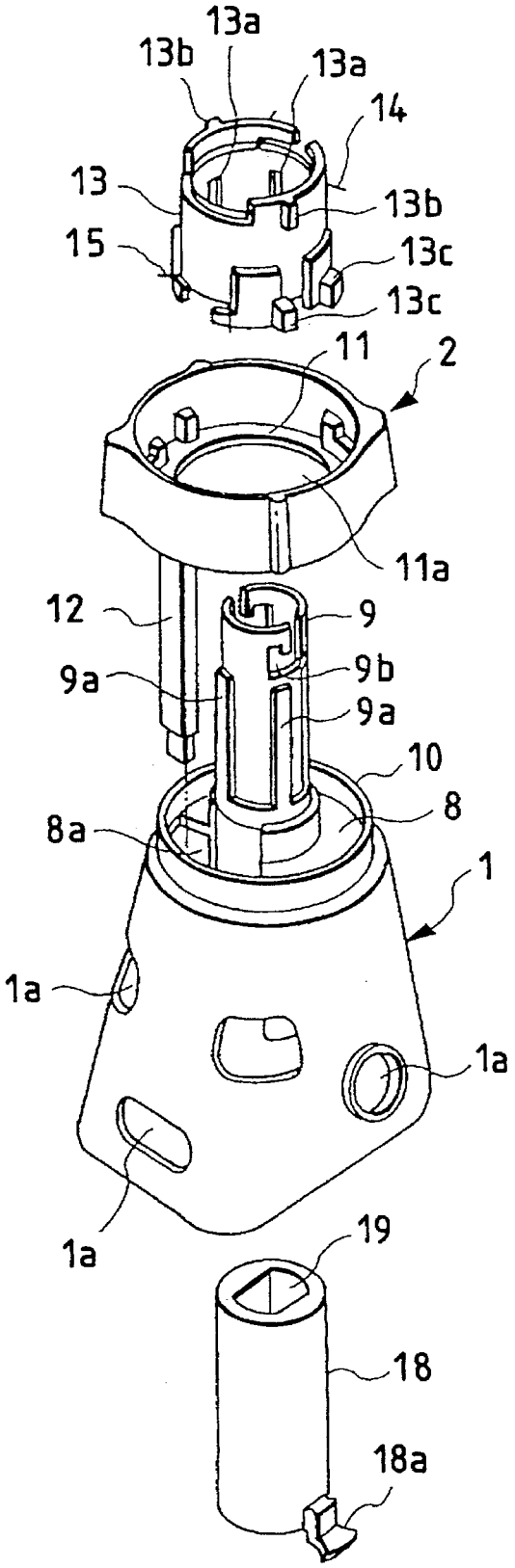
FIG. 3 is an exploded perspective view of the elements including a housing and an operation ring provided for the switching apparatus.
Figure 4:
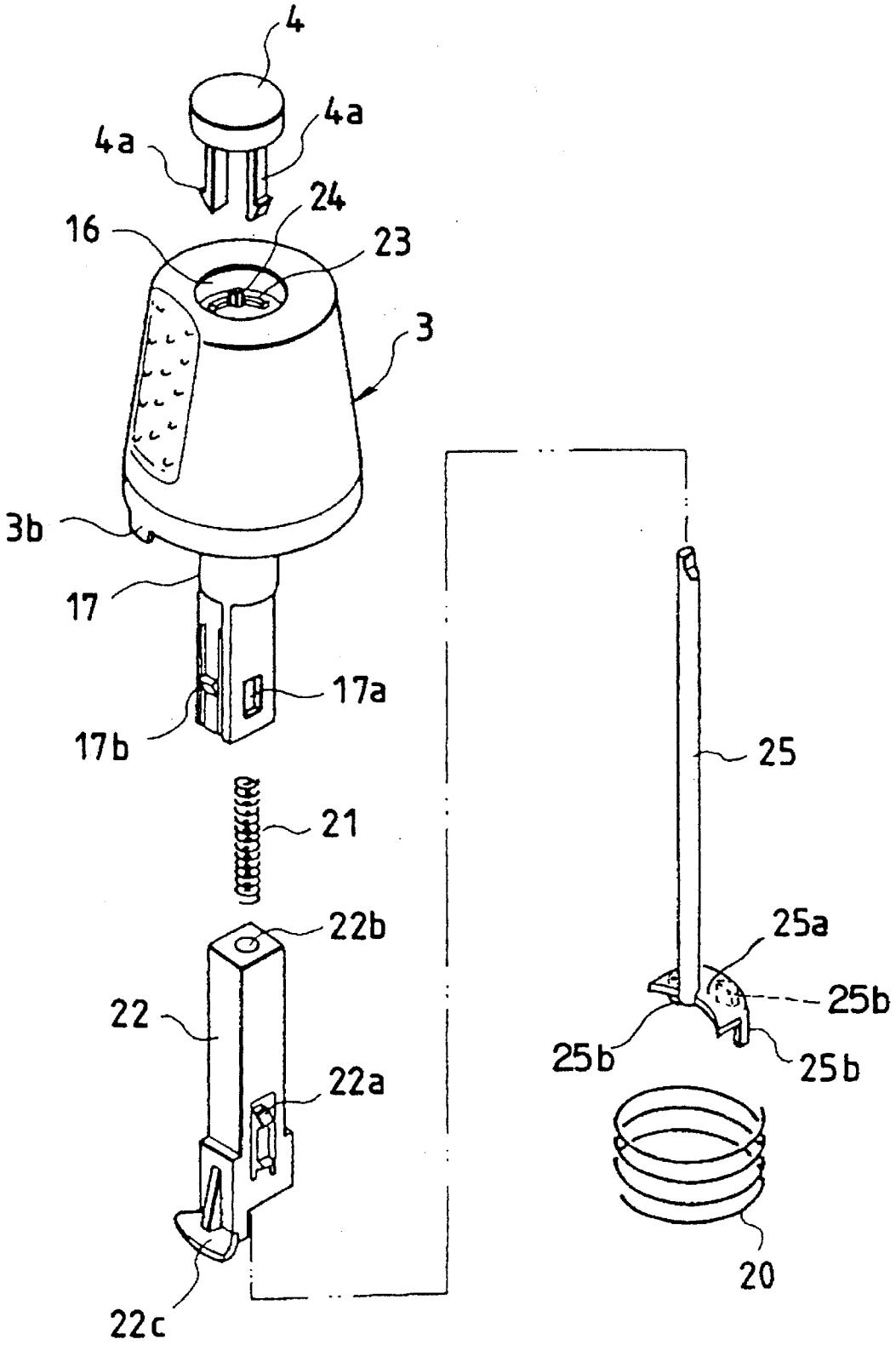
FIG. 4 is an exploded perspective view of the elements including an operation unit provided for the switching apparatus.
Figure 5:
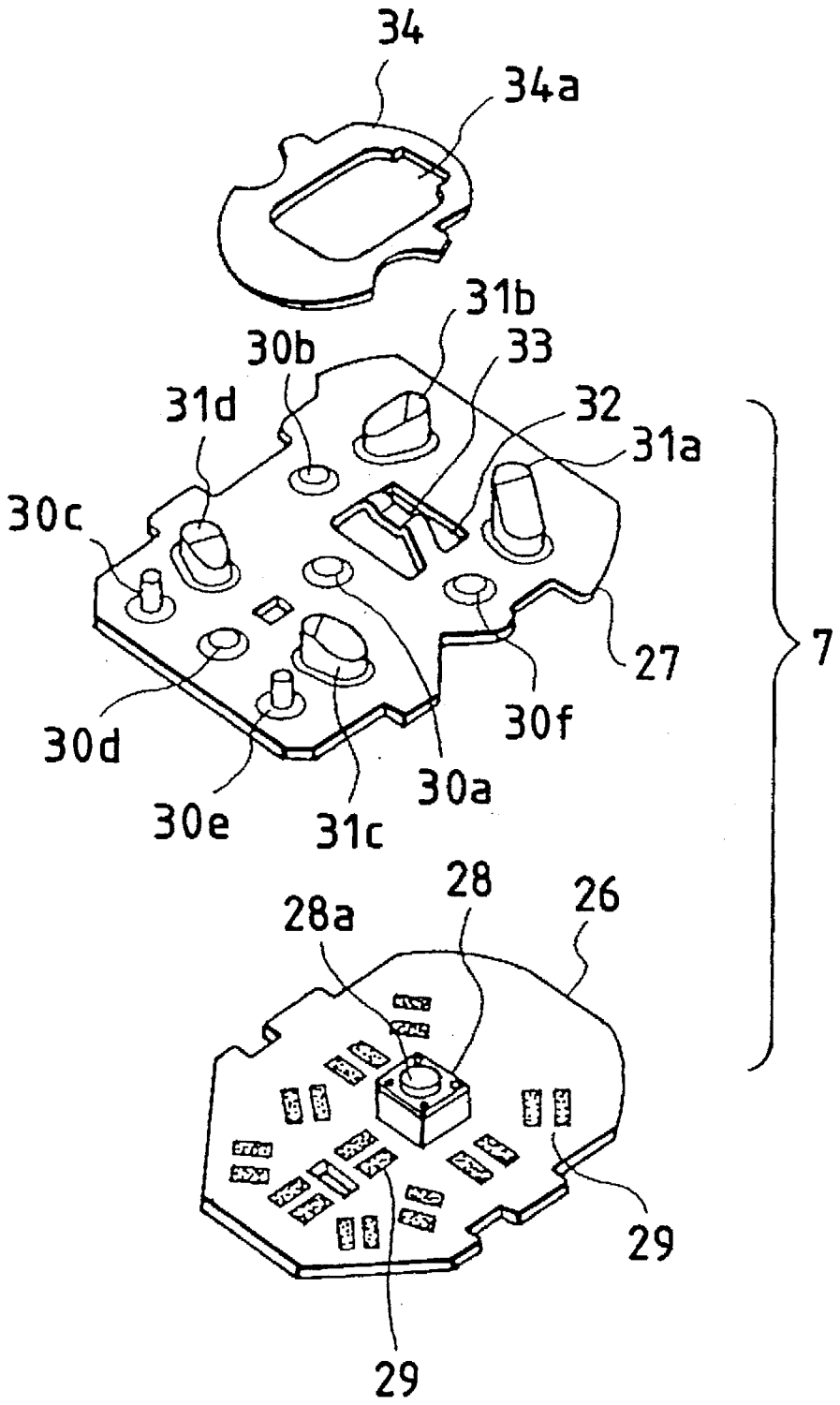
FIG. 5 is an exploded perspective view of a switching device provided for the switching apparatus.
Figure 6:
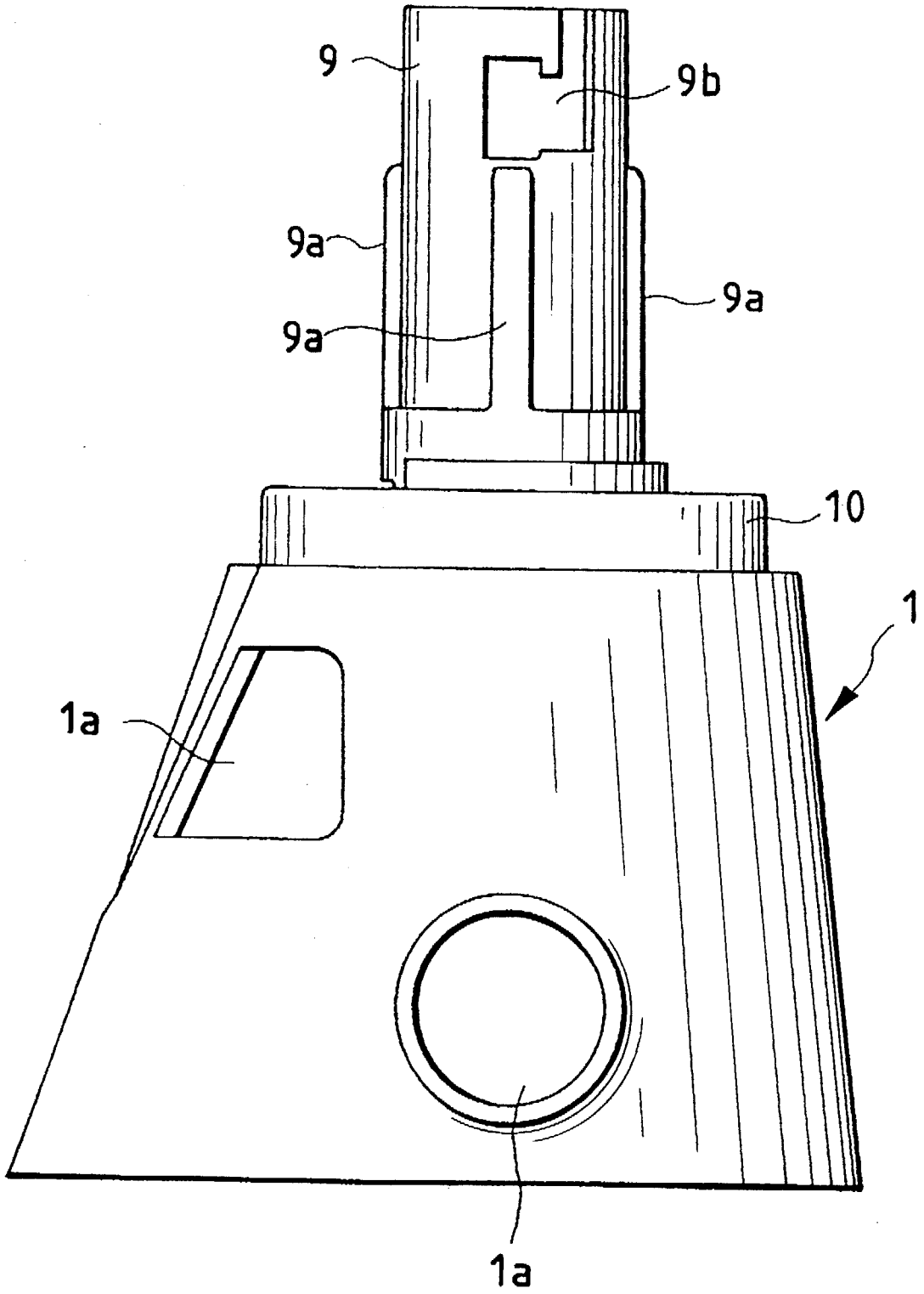
FIG. 6 is a front view of the housing.
Figure 7:
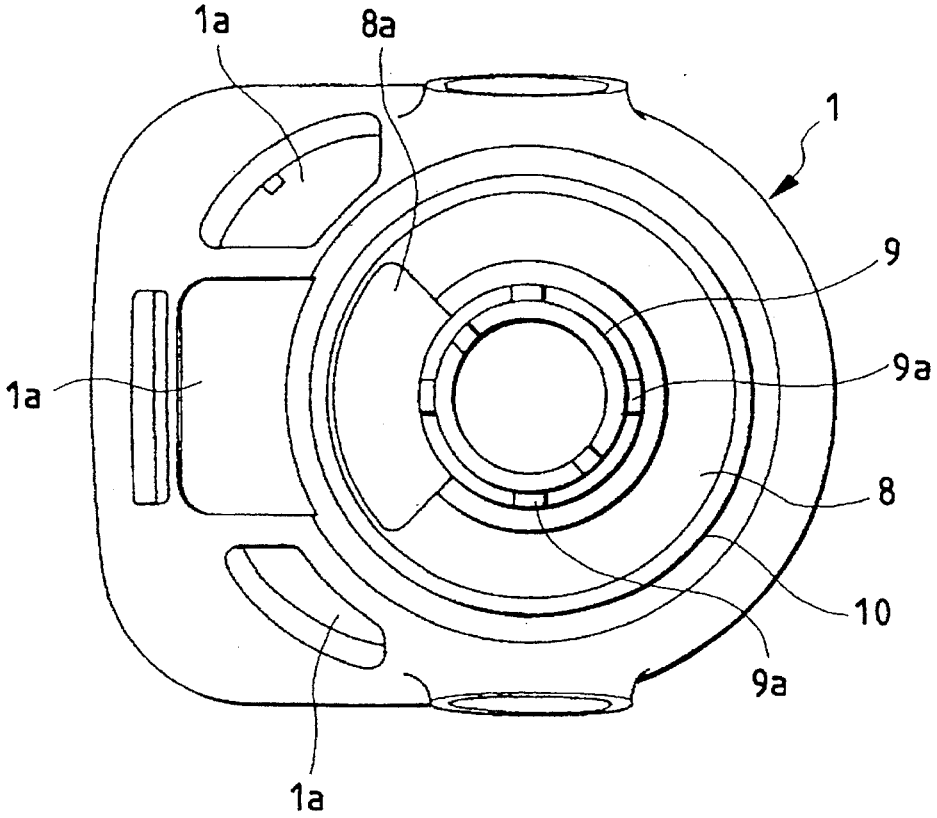
FIG. 7 is a top view of the housing.
Figure 8:
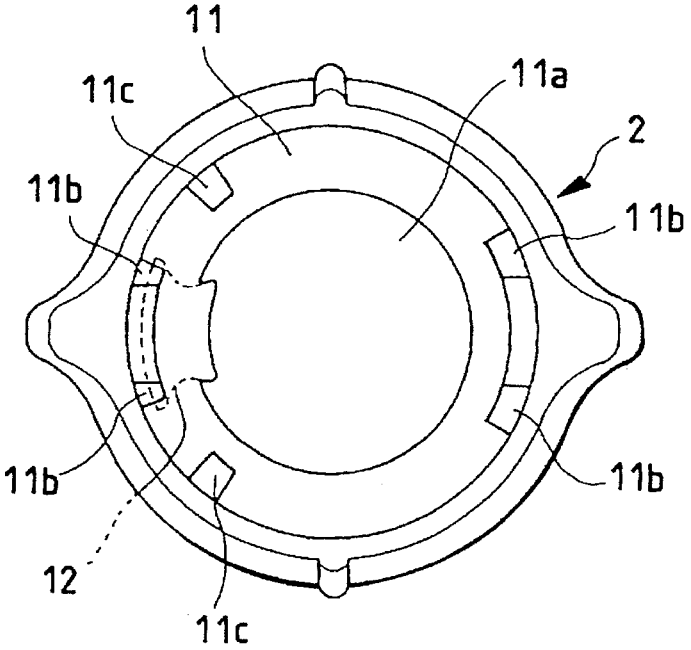
FIG. 8 is a front view of the operation ring shown in FIG. 3.
Figure 9:
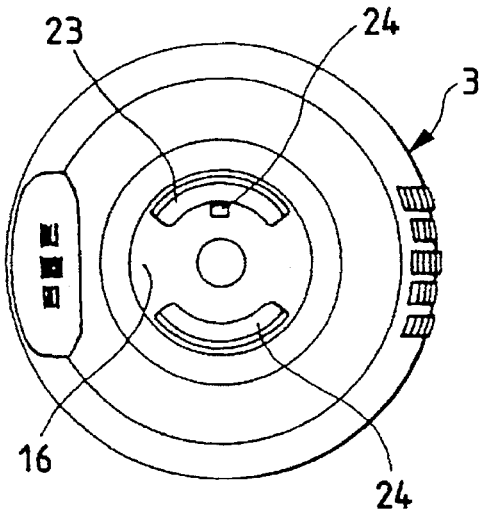
FIG. 9 is a top view of the operation unit shown in FIG. 4.
Figure 10:
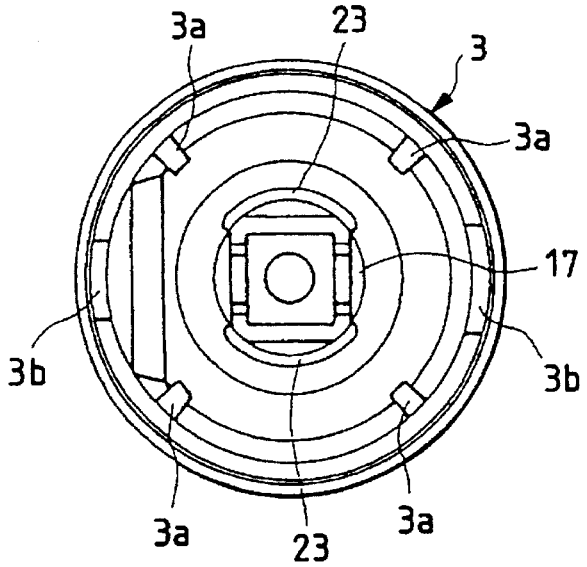
FIG. 10 is a bottom view of the operation unit.
Figure 11:
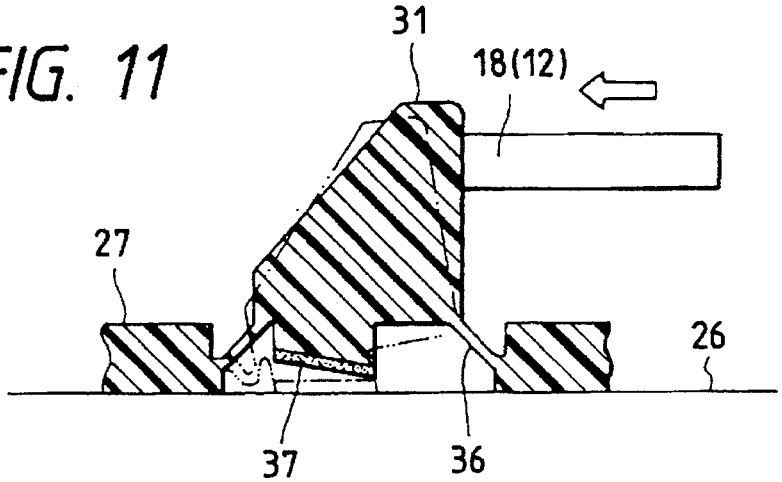
FIG. 11 illustrates the operation of a rotation detecting switch provided for the switching apparatus shown in FIG. 1.

FIG. 1 is a front longitudinal sectional view of a combined-operation type switching apparatus according to one embodiment of the present invention. FIG. 2 is a side longitudinal sectional view in the switching apparatus. FIGS. 3–5 are exploded perspective views illustrating the switching apparatus. FIG. 6 is a front view of a housing provided for the switching apparatus. FIG. 7 is a top view of the housing. FIG. 8 is a front view of an operation ring provided for the switching apparatus. FIG. 9 is a top view of an operation unit provided for the switching apparatus. FIG. 10 is a bottom view of the operation unit. FIG. 11 illustrates the operation of a rotating detection switch provided for the switching apparatus.

A combined-operation type switching apparatus according to this embodiment largely comprises a housing 1 forming an outer shell, an operation ring 2 rotatably held by the housing 1, an operation unit 3 rotatably and slidably held by the housing 1, an operation button 4 disposed on the top surface of the operation unit 3, a plurality of actuators 5 disposed on a lateral surface of the housing 1, a cover 6 for covering an opened end at the bottom portion of the housing 1, and a switching device 7 disposed inside the housing 1. The switching apparatus schematically constructed as described above may be attached, for example, around a steering wheel of a vehicle by suitably fixing the cover 6 to a mounting surface by such means as screws or double-sided adhesive tape.

The housing 1 is formed of a synthetic resin material, and an interposing wall 8 extending in the horizontal direction is integrally formed on the top end of the housing 1. A plurality of openings 1*a* are provided on the lateral surfaces of the housing 1. A vertically-extending guide tube 9 is disposed at the center of the interposing wall 8, and a loop-like collar 10 protruding slightly upward is raised from the outer peripheral region of the interposing wall 8. The guide tube 9 and the collar 10 are located coaxial with each other. The guide tube 9 includes a larger diameter cylindrical section integrally molded with the wall 8. The larger diameter section of the guide tube 9 includes a lower portion extending downward from the wall 8 into the housing 1, and a short portion extending above the wall 8. The guide tube 9 also includes a smaller diameter section extending above the larger diameter section, wherein the smaller diameter section and larger diameter section meet at a step. Four projecting strips 9*a* are formed on the outer peripheral surface of the smaller section at regular intervals at approximately 90°, while a pair of key-shaped notches 9*b* are formed on the upper portion of the smaller section. An opening 8*a* positioned between the guide tube 9 and the collar 10 is provided for the interposing wall 8. The larger section of the guide tube 9 is partially notched along this opening 8*a*.

The operation ring 2 is formed of a synthetic resin material and is rotatably mounted around the collar 10. A flange 11 having a center hole 11*a* is integrally formed with the ring 2. A drive rod 12 is further provided perpendicularly from the bottom surface of the flange 11 so as to pass through the opening 8*a* and to extend downward into the housing 1. On the other hand, as shown in FIG. 8, two pairs of engaging projections each pair having two projections 11*b* circumferentially located at regular intervals, and two stopper projections 11*c* positioned farther outward than one pair of the engaging projections 11*b* are disposed on the top surface of the flange 11. The two pairs of the engaging projections 11*b* opposedly face each other across the center hole 11*a* (see FIG. 8).

The operation ring 2 is rotatably fit around the collar 10 of the housing 1, as has been discussed above, and is further prevented from detaching from the housing 1 by means of a synthetic resin-formed securing tube 13 fit around the guide tube 9. More specifically, four recessed grooves 13*a* are circumferentially formed across spacing at approximately 90° on the inner peripheral surface of the securing tube 13. The above-described projecting strips 9*a* are respectively fit into the recessed grooves 13*a* so that the securing tube 13 fits around the outer peripheral surface of the guide tube 9. A pair of first projections 13*b* are formed on the upper portion of the securing tube 13 to opposedly face each other at approximately 180°, and also, a first torsion spring 14 is wound around and supported by the upper portion of the tube 13. On the other hand, two pairs of second projections 13*c* are formed on the lower portion of the tube 13 so that they face each other at approximately 180°, and also, a second torsion spring 15 is wound around and held by the lower portion of the tube 13. Both ends of the second torsion spring 15 come into contact with the inner wall of a first pair of the engaging projections 11*b* provided for the operation ring 2. With this construction, when the ring 2 is rotated either in the normal or the reverse direction, it automatically returns to the original position due to the elasticity of the second torsion spring 15. The rotation angle of the operation ring 2 is set to the angle $\theta_1$ ($\theta_1 \approx 45°$ in this embodiment) from the fact that the second pair of engaging projections 11*b* the and a pair of stopper projections 11*c* provided for the ring 2 abut against the second projections 13*c* provided for the securing tube 13.

Referring to FIG. 4, the operation unit 3 is formed of a synthetic resin material. A pit 16 having a circular shape, as viewed from the top surface, is provided at the center of the top surface of the operation unit 3. A hollow shaft 17 extends perpendicularly downward from the center of the bottom surface of the pit 16. This shaft 17 is formed of a tubular section at the upper portion and a prism section at the lower portion. Windows 17*a* are provided on both lateral walls of the prism portion opposedly facing each other, while retaining claws 17*b* are formed on the respective remaining both walls of the prism section. The shaft 17 is inserted into an upper opening of the guide tube 9 of the housing 1. The tubular section of the shaft 17 comes into contact with the smaller section of the guide tube 9, while the prism section is interconnected to a drive tube 18 formed of a synthetic resin (see FIG. 3). With this construction, the shaft 17 can be prevented from detaching from the guide tube 9. More specifically, a through hole 19 which is shaped to receive the shaft 17 is axially provided at an upper end of the drive tube 18. The above-described retaining claws 17*b* are retained inside the through hole 19 so that the drive tube 18 and the shaft 17 are connected together inside the larger section of the guide tube 9 as shown in FIG. 1. The upper end of the drive tube 18 abuts against the step formed between the smaller section and the larger section of the drive tube 9, thereby preventing the guide tube 18 from moving upward (see FIG. 1). For the connection between the shaft 17 and the drive tube 18, the two elements are snap coupled in such a manner that the prism section of the shaft 17 and the drive tube 18 are spline-connected to each other due to the formation of the through hole 19. With this construction, only the rotational torque of the shaft 17 can be transmitted to the drive tube 18. Additionally, a drive projection 18*a* is formed at the bottom end of the drive tube 18.

Four projections 3*a* are circumferentially formed on the inner peripheral surface of the operation unit 3 across spacing at approximately 90° (see FIG. 10). Both ends of the first torsion spring 14 held by the above-described securing tube 13 come into contact with the inner wall of the adjacent two projections 3*a*. When the operation unit 3 is rotated either in the normal or reverse direction, it automatically returns to its original position due to the elasticity of the first torsion spring 14. The rotation angle of the operation unit 3 is set to be the angle $\theta_2$ ($\theta_2 \approx 70°$ in this embodiment) from the fact that the aforementioned projections 3*a* respectively abut against the first projections 13*b* of the securing tube 13. The relationship of the rotation angle $\theta_2$ to the foregoing rotation angle $\theta_1$ of the operation ring 2 is set to be $\theta_1<\theta_2$. Further, a pair of engaging projections 3*b* are formed at the bottom end of the peripheral surface of the operation unit 3 in positions in which they opposedly face each other at approximately 180°. The projections 3*b* are respectively provided to engage and disengage with the projections 11*b* formed on the operation ring 2. More specifically, when the operation unit 3 is urged upward by a return spring 20 wound around the securing tube 13, that is, when the operation unit 3 is not pressed, the projections 3*b* are located upward in which they are not engaged with the projections 11*b*. Accordingly, the operation unit 3 and the ring 2 are independently rotated. On the other hand, when the operation unit 3 is pressed against the elasticity of the return spring 20, the projections 3*b* are moved downward to engage with the projections 11*b*. Accordingly, the operation unit 3 and the ring 2 are integrally rotated by way of the projections 3*b* and 11*b*. Since the rotation angle $\theta_2$ of the operation unit 3 is set greater than the angle $\theta_1$ of the ring 2, as has been discussed above, the resulting overall rotation angle when the two elements are integrally rotated is restricted to the smaller angle $\theta_1$.

A spring 21 and a drive unit 22 are sequentially inserted into the hollow portion of the shaft 17. The drive unit 22 is urged downward due to the elasticity of the spring 21. An elastic claw 22*a* is formed on each of the lateral walls of the drive unit 22 opposedly facing each other. The elastic claws 22*a* are respectively retained at the bottom ends of the windows 17*a*, thereby preventing the drive unit 22 from detaching from the shaft 17. However, the drive unit 22 and the shaft 17 are vertically movable within a region in which the elastic claws 22*a* are moved within the windows 17*a*. Additionally, a through hole is axially provided at the center of the drive unit 22, and a pressing portion 22*c* is formed at the bottom end of the drive unit 22.

As shown in FIG. 4, the operation button 4 is formed of a synthetic resin material and is placed within the pit 16 of the operation unit 3. A pair of engaging claws 4*a* are perpendicularly provided for the operation button 4. The claws 4*a* pass through the opening 23 provided at the bottom surface of the pit 16 and engage with the notch 9*b* of the guide tube 9, thereby protecting the button 4 from detaching from the guide tube 9 (see FIG. 2). Also, the engaging claws 4*a* are moved inside the opening 23 so that the button 4 can be pressed toward the housing 1 by a predetermined amount. However, the amount of movement of the button 4 is restricted by a pin 24 raised from the bottom surface of the pit 16 (see FIG. 4). Further, a drive shaft 25 is pressed into the button 4 and passes through the through hole 22*b* of the drive unit 22 so as to extend downward from the guide tube 9. A tabular drive portion 25*a* is disposed at the bottom end of the drive shaft 25, while three locating projections 25*b* are provided perpendicularly from the peripheral edge of the drive portion 25*a*.

As shown in FIGS. 1 and 2 the above-described actuators 5 are each formed of a synthetic resin material and partially protrude from the openings 1*a* provided on the lateral surfaces of the housing 1. The actuators 5 each have a pivot 5*a*. The pivot 5*a* is clamped by the cover 6 and the housing 5 so that it can be rotatably supported inside the housing 1.

The switching device 7 is constructed of an insulating base 26 formed of an insulating material, such as a phenol resin, a glass-epoxy resin, etc, and a rubber sheet 27 deposited on the insulating base 26 and formed of an elastic material, such as silicon rubber, etc. The insulating base 26 and the rubber sheet 27 are securely mounted on the cover 6 by such means as locating pins. As illustrated in FIG. 5, a tact switch 28 is soldered to the central portion of the insulating base 26, and a plurality of pairs of fixed contacts 29 (ten pairs in this embodiment) are printed on the surface of the base 26. The tact switch 28 incorporates a reversing spring and has a stem 28*a* protruding from the top end, and the stem 28*a* is pressed through the drive shaft 25 by depression of the operation button 4 so that the contacts are switched with a click. On the other hand, six swells 30 (30*a*–30*f*) and four projections 31 (31*a*–31*d*) are integrally formed on the rubber sheet 27. A window 28 into which the tact switch 28 is inserted and a band-like portion 33 for bridging two facing sides of the window 32 are also disposed on the rubber sheet 27. This band-like portion 33 is positioned on the stem 28*a* of the tact switch 28, and the drive portion 25*a* of the drive shaft 25 opposedly faces the stem 28*a* of the tact switch 28 across the band-like portion 33. A lubricating sheet 34 formed of a material having high lubricating properties, such as PVC, teflon, etc. is placed on the top surface of the swell 30*a* located substantially at the center of the rubber sheet 27. The locating projections 25*b* of the drive shaft 25 abut against the outer peripheral edge of an opening 34*a* provided for the lubricating sheet 34 so that the sheet 34 is located inside the projections 31*a*–31*d*.

The swells 30 of the rubber sheet 27 each project above the rubber sheet 27 via a dome-like thin-walled portion 35. Among the swells 30, the swell 30*a* positioned substantially at the center of the rubber sheet 27 opposedly faces the pressing portion 22*c* of the drive unit 22 via the lubricating sheet 34, while the remaining swells 30*b*–30*f* abut against part of the respective actuators 5. Also, the projections 31 protrude farther upward than the swells 30 via thin-walled portions extending obliquely upward from the top surface of the rubber sheet 27. Among the individual projections 31, a pair of projections 31*a* and 31*b* opposedly face each other across the drive projection 18*a* of the drive tube 18, while the other pair of projections 30*c* and 30*d* opposedly face each other across the bottom end of the drive rod 12. Movable contacts 37 are each disposed on the inner bottom surface of each of the corresponding swells 30 and the corresponding projections 31. The movable contacts 37 opposedly face at predetermined spacings, the respective pairs of the fixed contacts 29 provided on the insulating base 26. The movable contacts 37 of the swells 30 are placed in parallel to the surface of the insulating base 26. As shown in FIG. 11, however, each of the movable contacts 37 of the projections 31 is biased away from the drive projection 18*a* or the drive rod 12 with respect to the center of the projection 31, and is also slanted away from the surface of the insulating base 26 as it is further biased.

An explanation will now be given of the operation of the combined-operation type switching apparatus according to this embodiment.

FIGS. 1 and 2 illustrates the switching apparatus in a non-operating state. In this non-operating state, the drive projection 18*a* of the drive tube 18 is located substantially at the center of a pair of projections 31*a* and 31*b*, while the bottom end of the drive rod 12 is positioned substantially at the center of a pair of projections 31*c* and 31*d*. With this construction, the respective projections 31*a*–31*d* are not subjected to a rotation pressing force caused by the drive tube 18 or the drive rod 12, and the movable contacts 37 of the respective projections 31*a*–31*d* separate from the respective pairs of fixed contacts 29. Under these conditions, all the rotation detecting switches are in the off state. The spring 21 interposing between the shaft and the drive unit 22 is formed so that the drive unit 22 is subjected to a small force from the spring 21 and is thus elastically urged downward. The movable contact 37 of the swell 30*a* separates from the corresponding pair of fixed contacts 29 across a predetermined distance $L_1$. Accordingly, the central push switch is also in the off state. Further, the actuators 5 are subjected to a reaction force from the swells 30*b*–30*f* and are urged to be projected from the openings 1*a*. The movable contacts 37 of the swells 30*b*–30*f* also separate from the corresponding pairs of fixed contacts 29. Accordingly, the remaining push switches are also in the off state.

When the operator depresses the operation button 4 in the non-operating state shown in FIGS. 1 and 2, the button 4 and the drive shaft 25 are moved downward so as to allow the drive portion 25*a* of the drive shaft 25 to press the stem 28*a* of the tact switch 28 through the band-like portion 33. Accordingly, a click produced by the pressing operation travels to the operator from the tact switch 28 through the drive shaft 25 and the operation button 4. The tact switch 28 is thus turned on. When the aforementioned pressing force acting upon the operation button 4 is canceled, the drive shaft 25 automatically returns to the position shown in FIGS. 1 and 2 due to the elasticity of a reverse spring (not shown) built into the tact switch 28 and due to the elasticity of the band-like portion 33. The tact switch 28 thus returns to the off state.

When the operator pushes the operation unit 3 against the return spring 20 in the non-operating state, the shaft 17 is caused to slide against the guide tube 9, thereby lowering the operation unit 3. The sliding amount of the shaft 17 is restricted to a distance $L_2$ from the fact that the bottom ends of the projections 3*b* abut against the operation ring 2. When the shaft 17 is lowered to shorten the relative axial distance between the shaft 17 and the drive unit 22, the spring 21 is compressed and exerts a strong elastic force on the drive unit 22, which is then moved downward, further causing the pressing portion 22*c* of the drive unit 22 to press the top surface of the swell 30*a* through the lubricating sheet 34. Because of this pressing force, the thin-walled portion 35 of the swell 30*a* is buckled and deflected, and accordingly, the movable contact 37 disposed on the inner bottom surface of the swell 30*a* is brought into contact with the corresponding pair of fixed contacts 29 provided on the insulating base 26. The central push switch is thus changed to the on state. A click produced by this on state of the push switch travels to the operator through the drive unit 22, the spring 21 and the operation unit 3. For this operation, the relationship between the stroke amount $L_1$ in which the movable contact 37 of the swell 30*a* comes into contact with the associated pair of fixed contacts 29 and the sliding amount $L_2$ of the operation unit 3 is set to be $L_2>L_1$. Based on this relationship, while the central push switch is in the on state, the spring 21 is compressed by the amount expressed by $L_2-L_1$ so as to elastically urge the drive unit 22, thereby maintaining the contact state between the movable contact 37 and the associated pair of fixed contacts 29 due to this elastic force of the spring 21. When the above-described pressing force acting upon the operation unit 3 is canceled, the drive unit 22, the spring 21 and the operation unit 3 return to their original positions shown in FIGS. 1 and 2, due to the elasticity of the thin-walled portion 35. The central push switch thus returns to the off state.

When the operator rotates the operation unit 3 either in the normal or reverse direction without pressing it in the non-operating state, the shaft 17 of the operation unit 3 is rotated inside the guide tube 9, and the drive tube 18 spline-connected to the unit 3 is also rotated in the same direction as the shaft 17. The drive tube 18 is thus rotated so as to allow the drive portion 18*a* to press the lateral surface of the projection 31 located in the forward rotating direction between a pair of projections (31*a* and 31*b*). Because of this pressing force, as indicated by the two-dot chain lines shown in FIG. 11, the thin-walled portion 36 of the projection 31 is obliquely buckled and deflected away from the drive projection 18*a*, thus producing a click, which then travels to the operator through the drive tube 18 and the operation unit 3. In the manner described above, the projection 31 is tilted so as to allow the movable contact 37 disposed on the inner bottom surface of the projection 31 to come into contact with the associated pair of fixed contacts 29, thereby changing one of the rotation detecting switches to the on state. As has been previously discussed, since the movable contact 37 is biased to be away from the pressing element with respect to the center of the projection 31, it can be brought into contact with the associated fixed contacts 29 even if the projection 31 is tilted by only a small amount. The projection 31 continues to be elastically deformed even after the movable contact 37 has come into contact with the fixed contacts, thus resulting in an excess amount of stroke. When the torque acting upon the operation unit 3 is canceled, the unit 3 and the drive tube 18 return to their original positions due to a restoration force of the first torsion spring 14, and the pressed projection 31 returns to the position indicated by solid lines shown in FIG. 11 due to the elasticity of the thin-walled portion 36. The above-described rotation detecting switch thus returns to the off state.

Further, when the operator rotates the operation ring 2 either in the normal or reverse direction in the non-operating state, the ring 2 is rotated around the flange 10, and the drive rod 12 of the ring 2 is also rotated together with the ring 2 in the same direction. The drive rod 12 is thus rotated so that the lateral surface of the projection 31 located in the forward rotating direction between a pair of projections 31 (31*c* and 31*d*) is pressed by the bottom end of the drive rod 12. Because of this pressing operation of the projection 31*c* or 31*d*, as well as the operation of the projection 31*a* or 31*b*, one of the rotation detecting switch is thus turned on. When the above-described torque is canceled, the operation ring 2 returns to its original position due to a restoration force of the second torsion spring 15, and the pressed projection 31 returns to its raised state due to the elasticity of the thin-walled portion 36. The rotation detecting switch thus returns to the off state.

Still further, when the operator depresses a certain actuator 5 in the non-operating state, the selected actuator 5 pivots on its pivot 5*a* and also presses the top surface of the corresponding swell 30 (30*b*–30*f*). This pressing force buckles and deforms the thin-walled portion 35 of the corresponding swell 30, and accordingly, the movable contact 37 provided on the inner bottom surface of the swell 30 comes into contact with the associated pair of fixed contacts 29 provided with the insulating base 26. A peripheral push switch is thus changed to the on state, thus producing a click, which then travels to the operator through the actuator 5. When the pressing force acting upon the actuator 5 is canceled, the actuator 5 returns to its original state due to the elasticity of the thin-walled portion 35 of the corresponding swell 30. The peripheral push switch thus returns to the off state.

On the other hand, when the operator rotates the operation unit 3 either in the normal or reverse direction in the non-operating state, while pressing the unit 3, the projections 3*b* of the operation unit 3 respectively engage with the projections 11*b* provided for the ring 2, whereby the operation unit 3 and the ring 2 are rotated integrally with each other. During this integral rotation, the relationship between the rotation angle $\theta_1$ of the ring 2 and the rotation angle $\theta_2$ of the operation unit 3 is set to be $\theta_1<\theta_2$, as has been previously discussed. Based on this relationship, when the rotation of the ring 2 is restricted, the operation unit 3 ceases to rotate, which prevents a switching operation of a pair of projections 31*a* and 31*b* actuated by the drive projection 18*a* of the drive tube 18. In this case, a pressing operation of the swell 30*a* is performed by means of the operation unit 3, and a pressing operation of a pair of projections 31*c* and 31*d* is also performed by means of the ring 2. Then, a switching signal, which is different from the one when both the operations are independently performed, is output. For this integral switching operation, the drive unit 22 is rotated in cooperation with the operation unit 3 while pressing the swell 30*a*. The drive unit 22 presses the swell 30*a* due to an elastic force of the spring 21, as has been discussed above. Because of this construction, any slight axial fluctuations of the operation unit 3, which may occur during the rotation, is absorbed by the spring 21, thereby ensuring a reliable contact between the movable contact 37 provided for the swell 30*a* and the corresponding pair of fixed contacts 29. Besides, the lubricating sheet 34 intervenes between the pressing portion 22*c* of the drive unit 22 and the swell 30*a* of the rubber sheet 27. There is a disparity in the coefficient of friction between the drive unit 22 formed of a synthetic resin material and the rubber sheet 27 formed of silicon rubber or the like. Because of this disparity, the lubricating sheet 34 is not rotated in relation to the swell 30*a*, while the bottom surface of the pressing portion 22*c* of the drive unit 22 slides on the top surface of the lubricating sheet 34, thereby preventing damage to the swell 30*a*.

In the manner described above, in this embodiment, the operator rotates the operation unit 3 while pressing it, thereby causing the push switch (the swell 30*a*) and the rotation detecting switch (the projection 31*c* or 31*d*) to be turned on simultaneously. During this operation, the contact state between the movable contact 37 provided for the push switch and the associated pair of fixed contacts 29 is reliably maintained due to an elastic force of the spring 21. Accordingly, since the sole operation unit 3 is provided with a plurality of switching capabilities, the overall switching apparatus is downsized, and also, the unit 3 can be operated by touch without having to make a visual check. With these advantages, it is possible to provide a combined-operation type switching apparatus suitable for a use in a car.

Also, except for the tact switch operable by the actuation button 4, the movable contacts 37 of the respective rotation detecting switches and the push switches are integrally provided for the swell 30 and the projection 31. With this construction, elements required for these switches are only the insulating base 26 and the rubber sheet 27 placed on the base 26, thereby achieving a remarkable reduction in the number of parts and assembly processes.

Moreover, the lubricating sheet 34 is positioned to intervene between the pressing portion 22*c* of the drive unit 22 and the swell 30*a* of the rubber sheet 27. With this arrangement, when the operation unit 3 is rotated while being pressed, the lubricating sheet 34 is not rotated in relation to the swelled portion 30*a*, while the bottom surface of the pressing portion 22*c* of the drive unit 22 slides on the top surface of the lubricating sheet 34 in a rotating manner, thereby preventing damage to the swell 30*a*.

This embodiment has explained the following type of the combined-operation type switching apparatus. Namely, the operation unit 3 is rotated while being pressed, engaging means (engaging projections 3*b* or 11*b*) respectively provided for the operation unit 3 and the operation ring 2 are engaged so as to cause the rotation detecting switch (projection 31*c* or 31*d*) provided for the operation ring 2 to be turned on. However, the engaging means or the operation ring 2 may be omitted, and instead, the rotation detecting switch (projections 31*a* and 31*b*) provided for the operation unit 3 may be turned on. In this case, too, when a pair of projections 31*a* and 31*b* are actuated by the drive projection 18*a* of the drive tube 18, the drive unit 22 presses the swell 30*a* due to an elastic force of the spring 21, thereby maintaining a reliable contact between the movable contact 37 provided for the swell 30*a* and the associated pair of fixed contacts 29.

Further, although in this embodiment the operation ring 2, the button 4 and the respective actuators 5 in addition to the operation unit 3 are provided for the housing 1, these elements may be suitably omitted according to the intended purpose of use.

As will be clearly understood from the foregoing description, the present invention offers the following advantages.

The sole operation unit is singly pressed or rotated to cause the push switch or the rotation detecting switch to be independently turned on. In addition to this advantage, the operation unit is rotated while being pressed to cause both the push switch and the rotation detecting switch to be turned on simultaneously. With these advantages, it is possible to provide a combined-operation type switching apparatus which is downsized and exhibits excellent operability.

What is claimed is:

1. A combined-operation type switching apparatus comprising:

a housing including a guide tube;

an operation unit mounted on the housing, the operation unit including a shaft having an end inserted into the housing through the guide tube, the operation unit being movable along an axis of the shaft relative to the housing from a first axial position to a second axial position, the distance between the first and second axial positions being an operating distance, the operation unit also being rotatable around the axis of the shaft relative to the housing;

a first resilient member for biasing the operation unit in a direction of the axis of the shaft into the first axial position;

a drive unit movably attached to the end of the shaft such that the drive unit is slidable along the axis of the shaft relative to the operation unit, the drive unit including a pressing portion;

a second resilient member for biasing the drive unit away from the operation unit; and a push switch having a fixed contact fixedly mounted to the circuit board located within the housing, the push switch also having movable contact which is movable from a non-actuated position away from the fixed contact to an actuated position in which the movable contact abuts the fixed contact, a distance between the non-actuated position and the actuated position being a stroke length of the push switch;

wherein movement of the operation unit along the axis of the shaft from the first axial position to the second axial position causes the pressing portion of the drive unit to actuate the push switch by pushing the movable contact against the fixed contact; and wherein the operating distance of the operation unit is greater than the stroke length of the push switch such that actuation of the push switch occurs before the operation unit is moved into the second axial position, and subsequent movement of the operation unit toward the second axial position after actuation of the push switch causes compression of the second resilient member, thereby causing the pressing portion of the drive unit to reliably maintain actuation of the push switch when the operation unit is in the second axial position.

2. A combined-operation type switching apparatus according to claim 1, further comprising:

an operation ring rotatably mounted on the housing and co-axial with the shaft of the operation unit, the operation ring including a drive rod extending into the housing;

a rotation detecting switch having a fixed contact fixedly mounted to the circuit board, the rotation detecting switch also having a movable contact movably positioned adjacent the fixed contact, the movable contact being biased away from the fixed contact; and engaging means for engaging the operation unit and the operation ring when the operation unit is in the second axial position such that subsequent manual rotation of the operation unit causes rotation of the operation ring, thereby causing the drive rod to actuate the rotation detecting switch by pushing the movable contact against the fixed contact.

3. A combined-operation type switching apparatus according to claim 2, wherein the operation unit is rotatable relative to the housing over a first rotational range and the operation ring is rotatable relative to the housing over a second rotational range when the operation unit is in the first axial position, and wherein the rotational range of the operation unit is different from the second rotational range of the operation ring.

4. A combined-operation type switching apparatus according to claim 2, further comprising:

a second rotation detecting switch having a fixed contact fixedly mounted to a circuit board located within the housing, the rotation detecting switch also having a movable contact movably positioned adjacent the fixed contact, the movable contact being biased away from the fixed contact; and a drive tube connected to the shaft, the drive tube having a projection;

wherein rotation of the operation unit when the operation unit is in the first axial position causes rotation of the drive tube, thereby causing the projection to actuate the second rotation detecting switch by pushing the movable contact against the fixed contact.

5. A combined-operation type switching apparatus according to claim 1, further comprising a lubricating sheet located between the pressing portion of the drive unit and an upper surface of the push switch, wherein rotation of the operation unit relative to the housing when the operating unit is in the second axial position causes the drive unit to slide smoothly on the lubricating sheet.

6. A combined-operation type switching apparatus comprising:

a housing including a guide tube;

an operation unit mounted on the housing, the operation unit including a shaft having an end inserted into the housing through the guide tube, the operation unit being movable along an axis of the shaft relative to the housing from a first axial position to a second axial position, the distance between the first and second axial positions being an operating distance, the operation unit also being rotatable around the axis of the shaft relative to the housing from a first rotation position to a second rotation position;

a first resilient member for biasing the operation unit in a direction of the axis of the shaft into the first axial position;

a drive unit movably attached to the end of the shaft such that the drive unit is slidable along the axis of the shaft relative to the operation unit, the drive unit including a pressing portion;

a second resilient member for biasing the drive unit away from the operation unit;

a drive tube attached to the shaft and having a drive projection;

a rotation detecting switch having a fixed contact fixedly mounted to the circuit board, the rotation detecting switch also having a movable contact movably positioned adjacent the fixed contact, the movable contact being biased away from the fixed contact; and a push switch having a fixed contact fixedly mounted to the circuit board located within the housing, the push switch also having movable contact which is movable from a non-actuated position away from the fixed contact to an actuated position in which the movable contact abuts the fixed contact, a distance between the non-actuated position and the actuated position being a stroke length of the push switch;

wherein rotation of the operation unit from the first rotation position to the second rotation position when the operation unit is in the first axial position causes the drive projection of the drive tube to push the movable contact of the rotation detecting switch into the fixed contact, thereby actuating the rotation detection switch; and wherein movement of the operation unit along the axis of the shaft from the first axial position to the second axial position causes the pressing portion of the drive unit to actuate the push switch by pushing the movable contact against the fixed contact.

7. A combined-operation type switching apparatus according to claim 6, further comprising:

an operation ring rotatably mounted on the housing and co-axial with the shaft of the operation unit, the operation ring including a drive rod extending into the housing;

a second rotation detecting switch having a fixed contact fixedly mounted to the circuit board, the second rotation detecting switch also having a movable contact movably positioned adjacent the fixed contact, the movable contact being biased away from the fixed contact; and engaging means for engaging the operation unit and the operation ring when the operation unit is in the second axial position such that subsequent manual rotation of the operation unit causes rotation of the operation ring, thereby causing the drive rod to actuate the second rotation detecting switch by pushing the movable contact against the fixed contact.

* * * * *